US008182875B2

(12) United States Patent
Anderson et al.

(10) Patent No.: US 8,182,875 B2
(45) Date of Patent: May 22, 2012

(54) SYSTEM AND METHOD FOR PROTECTING A PRINT

(75) Inventors: Christine D. Anderson, Hamilton (CA); T. Brian McAneney, Burlington (CA); Christopher A. Wagner, Etobicohe (CA); Gordon Sisler, St. Catharines (CA)

(73) Assignee: Xerox Corporation, Norwalk, CT (US)

( * ) Notice: Subject to any disclaimer, the term of this patent is extended or adjusted under 35 U.S.C. 154(b) by 1017 days.

(21) Appl. No.: 11/696,954

(22) Filed: Apr. 5, 2007

(65) Prior Publication Data

US 2008/0248196 A1 Oct. 9, 2008

(51) Int. Cl.
*B05D 3/12* (2006.01)

(52) U.S. Cl. ..... 427/369; 427/370

(58) Field of Classification Search ..... 427/369, 427/370, 355

See application file for complete search history.

(56) References Cited

U.S. PATENT DOCUMENTS

| | | | | |
|---|---|---|---|---|
| 3,770,346 | A * | 11/1973 | Jordan | 399/92 |
| 6,535,712 | B2 * | 3/2003 | Richards | 399/341 |
| 6,723,784 | B2 * | 4/2004 | Ito et al. | 524/556 |
| 2006/0067757 | A1 * | 3/2006 | Anderson et al. | 399/341 |
| 2007/0092712 | A1 * | 4/2007 | Hodson | 428/304.4 |
| 2007/0282037 | A1 * | 12/2007 | Anderson et al. | 524/31 |

FOREIGN PATENT DOCUMENTS

| | | | |
|---|---|---|---|
| JP | 2000190639 | * | 7/2000 |
| JP | 2002049186 A | * | 2/2002 |

OTHER PUBLICATIONS

U.S. Appl. No. 11/421,299, filed on May 31, 2006 in the name of Christine D. Anderson et al.

* cited by examiner

*Primary Examiner* — Katherine A Bareford
*Assistant Examiner* — Tabatha Penny
(74) *Attorney, Agent, or Firm* — Oliff & Berridge, PLC

(57) ABSTRACT

A system and a method to protect an image on a substrate. The method includes applying a coating to the surface of a substrate having an unspread ink image thereon, wherein the image is formed by droplets of solid ink, and wherein the coating interacts with the ink. Moreover, the method includes spreading the coated ink on the surface of the substrate, wherein the ink and the coating interact during the spreading process and wherein the spread ink on the surface of the substrate forms the continuous image.

10 Claims, 1 Drawing Sheet

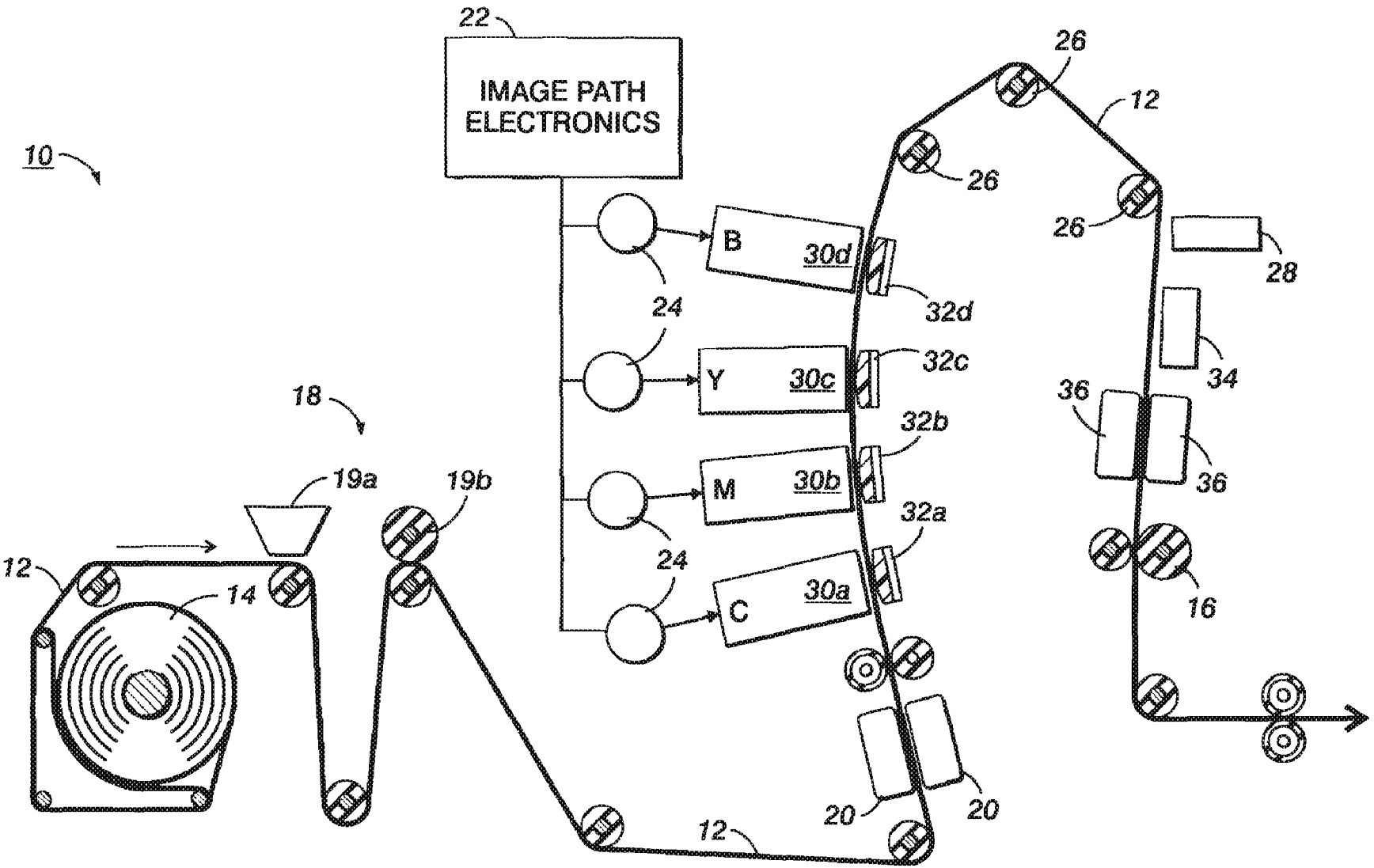
IMAGE PATH ELECTRONICS
22
24
24
B
Y
M
C
30d
30c
30b
30a
32d
32c
32b
32a
26
26
26
26
12
12
12
28
34
36
36
16
20
20
19a
19b
18
14
10

SYSTEM AND METHOD FOR PROTECTING A PRINT

TECHNICAL FIELD

This disclosure is directed to a system and a method for forming a robust print. More particularly, in embodiments, this disclosure is directed to a coating that is applied to the surface of a substrate with a direct to paper ink image thereon. The coating may be applied to the surface of the substrate after an ink jet printer has printed the image but prior to ink spreading of the image on the surface.

The interaction between the coating and ink during the ink spreading process may increase durability, permanency and consistency of the image formed on the surface of the substrate. As a result, robustness of the image may be improved by the increased interaction between the coating and the ink and damage caused from a force of movement such as rubbing, creasing, scratching and the like may be reduced.

CROSS-REFERENCE TO RELATED APPLICATIONS

Disclosed in commonly assigned U.S. patent application Ser. No. 11/421,299, filed May 31, 2006, is a recording medium with an ink image thereon, wherein a varnish at least partially covers the ink image, and wherein the varnish composition prior to application comprises at least one latex emulsion, water, at least one base and at least one surfactant.

The entire disclosure of the above-mentioned application is totally incorporated herein by reference.

BACKGROUND

An ink jet printer generates prints or images by transferring ink from ink jet heads to a substrate, such as coated paper stock or uncoated paper stock. One type of ink used in ink jet printers is a solid, or phase change, ink. In some cases, such ink images may be rubbed or scratched from the surface of a substrate by minimal force; for example, due to poor bonding between the ink and the surface of the substrate. A movement, such as rubbing, scratching or creasing of the ink on the substrate may exert sufficient force on the ink to separate the ink from the surface of the substrate.

A coating may be applied to the surface of the substrate, with a spread ink image thereon, to cover the surface during a finishing step. The coating covers the surface of the substrate to protect the ink of the image from being rubbed from or scratched from the surface of the substrate. The coating may be a continuous dry film that is formed over the ink of the image. However, by applying the coating as a finishing step, the coating may not bond sufficiently with the ink on the surface of the substrate because the coating may fail to interact with the ink. As a result, the coating may be removed from the surface of the substrate by rubbing, scratching or creasing, while the ink may remain on the substrate.

Because the coating typically covers the entire surface of the substrate, the coating may often enhance the gloss of the surface, which may increase the visual appeal of the print or image. However, the poor interaction between the coating and the ink may allow the coating to be easily removed from the substrate. As the coating is removed from the surface of the substrate, the continuous film formed by the coating may become non-uniform or non-continuous across the surface of the substrate. As a result, the coating removed from the surface may form one or more visual detects to the gloss or to the continuous film.

Therefore, a need exists for a system and a method for protecting an ink image on the surface of a substrate that may apply a coating to the surface of the substrate prior to ink spreading of an image. Additionally, a need exists for a system and a method for protecting an ink image with a coating that may increase the strength of the interaction between the ink and the coating, thereby improving the robustness of the print. Further, a need exists for a system and a method that may apply heat and/or pressure to the ink and coating for increased interaction. Moreover, a need exists for a system and a method that provides a coating to minimize damaging effects to the image caused by a force such as rubbing, scratching and creasing.

SUMMARY

The present disclosure addresses these and other needs, by providing a system and method for protecting a print. The system includes an ink delivery station, wherein the surface of the substrate is printable by ink from the ink delivery station, wherein the ink from the ink delivery station is in an unspread condition. Moreover, the system includes a coating station, wherein a coating from the coating station is applied to the image in the unspread condition. The coating interacts with the ink as the ink on the substrate changes from the unspread condition to a spread condition.

The method includes applying a coating to ink printed on the surface of a substrate, wherein the ink on the surface of the substrate is in an unspread condition. Moreover, the method includes bonding the coating and the ink as the ink changes from the unspread condition to a spread condition, wherein the ink in the spread condition forms the continuous image for the print. The interaction between the ink and coating prevents the ink or the coating from being removed from the surface of the substrate.

In embodiments, provided is a method for protecting a print. The method includes applying a coating to the surface of a substrate having an ink image thereon, wherein the image is formed by droplets of solid ink. Moreover, the method includes spreading the ink on the surface of the substrate, wherein the ink and the coating interact during the spreading of the ink.

Therefore, it is an advantage of the various embodiments described herein to provide a system and a method for protecting a print formed by an ink jet printer. The system and the method may have a coating that is applied to the image prior to spreading of the ink. Another advantage of the various embodiments is to provide a system and a method for protecting a print formed with ink that may utilize heat and/or pressure to increase the interaction between the ink and the coating. Yet another advantage of the various embodiments is to provide a system and a method for protecting a print that may, partially or entirely, apply a coating to the print after ink jetting an image but before spreading of the ink image. A further advantage of the various embodiments is to provide a system and a method for protecting a print that may increase durability, image permanence and robustness. Moreover, another advantage of the various embodiments is to provide a system and a method for protecting a print that may apply a coating to the print by a contact mechanism or a non-contact mechanism.

BRIEF DESCRIPTION OF THE DRAWING

The FIGURE illustrates an example system for protecting a print in an embodiment of the present disclosure.

EMBODIMENTS

As used herein, an ink spreading process refers to a process of moving ink in an unspread condition to a spread condition via ink spreading. For example, an ink spreading process may be a two roll nip formation that uses temperature and/or pressure to enlarge the solid ink drops on the surface of the substrate such that the spread solid ink drops overlap each other. Ink in an unspread condition refers to solid ink drops emitted onto the substrate that may not overlay each other and may not be uniform and/or continuous across the surface of the substrate. Ink in a spread condition refers to solid ink drops on the surface of the substrate that may have been enlarged to be uniform or continuous across the surface of the substrate and/or so that the solid ink drops overlay each other.

In various exemplary embodiments, there is provided a system and a method for protecting a print that may be formed on the surface of a substrate. The print may be an image that may be formed by ink from an ink jet printer. A coating may be applied to the surface of the substrate to cover and to protect the image from being removed from the substrate during rubbing, creasing or scratching. The coating is applied after the ink is jetted onto the surface of the substrate from an ink delivery station of the ink jet printer, but before the ink on the surface is exposed to a mid-heater, a glosser, a spreader or the like. The coating on the surface of the substrate may be exposed to heat and/or pressure during the ink spreading process by the glosser or the spreader. The interaction between the coating and the ink may prevent the ink and/or the coating from being removed from the surface of the substrate by the force from rubbing, scratching or creasing the image. As a result, application of the coating prior to spreading the ink may increase robustness and durability of the print, and may reduce visual defects of the print.

In embodiments, the substrate may be made from paper, such as coated paper stock, uncoated paper stock or any suitable coatable material. In embodiments, "substrate" may refer to or may include other substrates, such as transparencies, plastics and the like. In embodiments, the substrate may be fabricated with a pre-coating, such as a gloss that may cover a first side and/or a second side (collectively referred to hereinafter as "the sides") of the substrate. Ink may be applied to or may be printed onto one (simplex) or both (duplex) sides of the substrate to form an image on the sides of the substrate. In embodiments, the coating may be applied to or may cover the first side of the substrate to protect the image on the first side of the substrate. In embodiments, the coating may be applied to or may cover both of the sides of the substrate to protect a double-sided print having an image formed on each of the sides of the substrate. The coating may also cover only one or more portions of either side of the substrate.

In embodiments, the ink that is transferred to the substrate to form the image thereon may be, for example a liquid ink that is jetted onto the sides of the substrate. The ink may be, for example a solid ink or a phase change ink that may require heating to an elevated temperature prior to jetting onto the substrate. At the elevated temperature, the solid ink or the phase change ink may be converted into a liquid ink that is capable of being applied to the substrate via jetting or the like. It should be understood that the ink may be any suitable solid ink or phase change ink that is convertible to liquid ink at an elevated temperature for applying to the sides of the substrate.

Referring now to the drawing wherein like numerals refer to like parts, the FIGURE illustrates a system 10 for printing an image onto at least one of the sides of the substrate. In embodiments, the system 10 is an ink jet printer system such as, for example, a solid ink jet printer or the like. The system 10 may print or may transfer ink onto sides of the substrate via a direct-to-paper (hereinafter "DTP"), or direct to substrate printing operation.

In embodiments, the substrate may be, for example a reel of paper to be processed by the ink jet printer of the system 10. In embodiments, the substrate may be individual sheets of paper that may be fed singularly into the system 10 from a feed supply tray or the like. The paper web or individual sheets of paper may travel through or within the system 10 along a path 12 as shown in the FIGURE. In embodiments, the paper may move or may travel in rightward motion from a first position adjacent to the unwinder 14 through the ink jet printer to a second position beyond to the glosser 16. In embodiments, the system 10 may include a dirt abatement mechanism 18, a pre-heater 20, an imaging device 22 and an ink delivery station 24 for transferring ink onto the substrate to form one or more images of the print on the substrate. In embodiments, the system 10 may have tension rolls 26, an image sensor 28, a coating station 34, mid-heaters 36 and a glosser 16 for spreading ink on the substrate and for protecting one or more images formed thereon with a coating.

For supply rolls, the unwinder 14 unrolls the substrate. The substrate may be moved to the dirt abatement mechanism 18 to clean dirt, debris and the like from the sides of the substrate. The dirt abatement mechanism 18 may have an air source 19*a* and/or a sticky roll 19*b* to remove the dirt and the debris from the sides of the substrate via air and/or an adhesive, respectively. The substrate may be moved to the preheater 20, and may be exposed to heat emitted from the preheater 20 for preparing the substrate to receive ink thereon.

The substrate may be moved to a position adjacent to the ink delivery station 22 along path 12 for receiving ink from one or more heads 30*a*-30*d* of the ink delivery station 22. The heads 30*a*-30*d* may apply or may transfer ink of one or more colors to the sides of the substrate to print an image. The imaging device 24 may have electronics that are programmed to control the heads 30*a*-30*d* for applying ink of one or more colors onto the substrate to form the image.

Backup rolls 32*a*-32*d* may maintain the substrate in a position adjacent to the heads 30*a*-30*d*, respectively. Ink from one or more of the heads 30*a*-30*d* may be transferred to the sides of the substrate, and may form the image of the print on the sides of the substrate. As a result, ink from one or more of the heads 30*a*-30*d* may form one or more images that may be a single-colored image or a multi-colored image.

In embodiments, one or more of the heads 30*a*-30*d* may spray molten or melted solid ink directly onto the sides of the substrate in small droplets to form the image on the substrate. However, the image formed by the small droplets may not be a continuous image because a portion of the small droplets of solid ink may not overlap each other. The small droplets of solid ink may require spreading to expand and overlap each other to form an image that is continuous on the substrate. Additionally, the small droplets may require heating along with the spreading to increase expansion and to form the continuous image.

The substrate may move along the path 12 past tension rolls 26 to a position adjacent to image sensor 28 to detect defects in the one or more images formed on the substrate. In embodiments, the image sensor 28 may determine whether the image is accurately printed. It should be understood that the images may be printed on the substrate by any ink jet printing process or any DTP printing operation as known to one of ordinary skill in the art.

The substrate may be moved to a position adjacent to the coating station 34. The coating station 34 may be located between the ink delivery station 24 and the mid-heaters 36 or may be located downstream with respect to the ink delivery station 24. The coating station 34 may apply or may transfer a coating onto the side(s) of the substrate after the DTP printing operation of the ink delivery station 24 has printed ink onto the side(s) of the substrate. In embodiments, application of the coating by the coating station 34 to the side(s) of the substrate may be identified as a pre-finishing step within a continuous solid ink jet print process. "Pre-finishing step" refers to a step in a print process which may be completed prior to exposing ink on the substrate to an ink spreading device or ink spreading procedure.

In embodiments, the coating may be an aqueous-based coating, such as the varnish as set forth above and disclosed in previously incorporated U.S. patent application Ser. No. 11/421,299, or any commercially available aqueous coating. In embodiments, the coating may permit simplex/duplex coating for deposition of the coating on the substrate via a gravure method or an offset gravure method. The coating may be, for example, a water-based acrylic coating or the like. In embodiments, the coating may be made of a composition containing ammonium hydroxide, propylene glycol, carbitol, acrylic acid and/or styrene. It should be understood that the coating may be any coating known to one skilled in the art that may dry over a broad temperature range and which forms a film over the ink.

The coating station 34 may utilize a contact mechanism or a non-contact mechanism for applying the coating onto the sides of the substrate. The coating may be applied to the sides of the substrate by the coating station 34 via a coating method, such as, for example the gravure method, the offset gravure method, a kiss roll method, a spray method or the like. The present disclosure should not be deemed limited to a specific embodiment of the coating method utilized by the coating station 34 of the system 10. The coating station 34 may apply the coating onto the sides of the substrate having the ink or the image that is unspread. That is, the coating is desirably applied to surface of the substrate having an ink image thereon prior to ink spreading of the image.

The substrate may be moved to a position adjacent to the mid-heaters 36. The substrate and the coating may be exposed to heat emitted from the mid-heaters 36 to heat the ink, coating and substrate prior to submitting the substrate to the glosser 16. As a result, the heat from the mid-heaters 36 may initiate drying and reduce moisture within the coating as well as the ink and substrate which is covered by the coating. The heat applied to the substrate by the mid-heaters 36 may increase interaction between the ink and the coating. As a result, the coating may begin interacting with the ink, and may begin to dry as the substrate moves past the mid-heaters 36. In embodiments, the interaction between the coating and the ink may refer to a mixing and/or a bonding between the coating and the ink that may be initiated by heat and/or pressure that may be applied to the substrate as the substrate pass through the system 10.

In embodiments, the mid-heaters 36 may include infrared heaters for exposing the substrate, ink and coating to heat. The substrate passes through the infrared of the mid-heaters 36 for drying of the coating on the substrate. As a result, the dried coating on the substrate may have a coating thickness suitable to cover the unspread sample image with the dried coating.

The substrate may move from the mid-heaters 36 to a position adjacent to the glosser 16 for spreading of the small droplets of solid ink and coating on the substrate. In embodiments, "glosser" refers to a spreader that may apply pressure and/or heat to the ink droplets to spread the ink droplets to form the continuous image. The coating may be applied to the substrate and may cover a non-continuous image formed by the small droplets of solid ink that have not yet been spread. The coating and the ink may interact on the surface of the substrate during the spreading by the glosser 16.

The glosser 16 may apply heat and/or pressure to the substrate for spreading the small droplets of solid ink on the substrate. The glosser 16 may have rollers for exerting pressure onto the substrate as the substrate passes through the glosser 16 and between the rollers. In embodiments, the heat applied to the substrate by the glosser 16 may be in a range of about 40° C. to about 70° C. and more specifically in a range of about 50° C. to about 60° C. In embodiments, the pressure applied to the substrate by the glosser 16 may be in a range of about 750 psi to about 1,000 psi and more specifically in a range of about 750 psi to about 850 psi.

The heat and/or the pressure applied by the glosser 16 may be applied to the small droplets of solid ink on the substrate. As a result, the glosser 16 may spread the small droplets of solid ink on the substrate to form a continuous or final image for the print. The pressure applied to the small droplets may cause the small droplets to expand and to overlap each other to form the continuous image of the print on the sides of the substrate. The heat applied to the small droplets may increase expansion of the droplets from the applied pressure. As a result, the small droplets may be spread and may form the continuous image of the print on the substrate.

The heat and/or the pressure applied to the substrate by the glosser 16 may soften the ink and/or the coating on the substrate. A softening of the ink and/or the coating may encourage or may permit interaction between the ink and the coating thereon. With the ink and/or the coating in a softened state, the glosser 16 may press or may mix the ink and the coating causing interaction between the coating and the ink. As a result, a strong interaction between the coating and the ink may be formed as the substrate passes through the glosser 16.

The interaction between the coating and the ink may be strong enough to prevent the coating from being separated or removed from the ink by a force from scratching, rubbing or creasing. Force may be applied to the image having the ink and the coating by a user, an object or the like. As a result, the bond between the ink and the coating may improve or may increase robustness of the image by preventing the ink and/or the coating from being removed by the force from scratching, rubbing or creasing. In embodiments, the coating may form a layer over the ink which is on the substrate. In embodiments, the coating and the ink may meld together to form a hybrid composition during the spreading process by the glosser 16. As a result, the hybrid composition may be bonded to the substrate during the spreading process.

Additionally, the ink and the coating in the softened state may interact with the substrate and may bond with the substrate. The interaction between the substrate, ink and coating may prevent the ink or the coating from being removed from the substrate via the force from rubbing, scratching or creasing the paper. With strong bonding between the substrate, the ink and the coating, the force may not be great enough to separate the coating from the ink or the substrate. As a result, the bonding between the coating and the ink or the substrate may protect the continuous image of the print on the substrate.

By applying the coating to the substrate prior to passing the substrate through the glosser 16, the coating interacts with the ink while being exposed to pressure and/or heat during passage through the glosser 16. This interaction between the ink and the coating may encourage a strong interaction between the coating and the ink which allows the coating to protect the ink from being rubbed or scratched off the substrate by minimal force. Thus, by applying the coating during a pre-finishing step, such as prior to exposing the substrate to the mid-heaters 36, the coating improves the durability, permanency and quality of the continuous image of the print on the substrate. Additionally, the coating may form a gloss over the continuous image that may enhance the visual appeal of the print, and may reduce formation of visual defects caused by removal of the coating from one or more portions of the continuous image.

The substrate may be moved from the glosser 16 to a position beyond the glosser 16. The image on the sides of the substrate may be continuous after the ink droplets are spread by the glosser 16. Further, the heat emitted from the glosser 16 may dry the solid ink and the coating for the continuous image on the sides of the substrate. As a result, after the substrate moves from the glosser 16, the continuous image of the print displayed on the substrate may be dried and protected by the coating.

EXAMPLE

Small droplets of solid ink were transferred from a low energy solid ink jet printer to a substrate, such as a piece of uncoated paper stock having a basis weight of about 75 gsm. The small droplets of solid ink on the substrate formed an unspread sample print by a DTP printing operation of the low energy solid ink jet printer. For coating, the substrate including an unspread sample print which was attached to a lead sheet and fed through a coater. The lead sheet, attached to the substrate having the unspread sample print (hereinafter "the image"), was fed through the coater at a speed of about 30 m/min. As a result, a film was formed on the image by the coater with a gravure roll of about 140 lines per inch.

The coated image was then placed on a belt of a fusion UV system and fed through the fusion UV system at a speed of about 60 ft/ml. As a result, the image and the coating were allowed to dry with the heat generated by a UV light of the fusion UV system. The heat generated by the UV light was at a temperature of, for example about 54.4° C. As a result, the dried coating had a coating thickness in a range of about 1.5 microns to about 2 microns. This formation of the coating provided sufficient wetting to allow for coating over the unspread sample image formed by the solid ink jet printer.

The unspread sample print including the dried coating was positioned within the solid ink jet printer to allow for spreading of the sample print. After spreading, the spread sample print with the coating (hereinafter "Sample 1") did not exhibit an offset of either ink or coating to a drum used for spreading Sample 1. An unspread sample print (hereinafter "Comparative Sample 1") and a spread sample print with no coating (hereinafter "Comparative Sample 2") were also created by the DTP printing operation of the solid ink jet printer.

Scanning electron microscope images of Sample 1 and Comparative Samples 1 and 2 were acquired and examined to determine performance differences or structural differences. After reviewing the SEM images, structurally it was seen that the coating and ink had melded together during the coating process, as evidenced by the one continuous layer on the substrate. Spreading of Sample 1 and Comparative Sample 2 was substantially similar and no indications of picking or offset for Sample 1 were identified from the SEM images. With regards to performance, when compared to a DTP print with no coating, the gloss was increased by about approximately 10 gloss units (when measured at a 60 degree angle), rub was decreased by about at least 50% and crease remained the same.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A method for protecting a print comprised of ink, the method comprising:

applying a coating to ink printed on a surface of a substrate, wherein the ink on the surface of the substrate is in an unspread condition; and interacting the coating and the ink as the ink changes from the unspread condition to a spread condition, and wherein the ink in the spread condition forms the image for the print, wherein the interacting comprises using heaters located on two sides of the substrate to apply heat to the substrate before the ink is in the spread condition and allowing the coating to dry, and wherein the interacting further comprises using a glosser after the coating has been allowed to dry, the glosser being located downstream from the heaters, the glosser being used to change the ink to the spread condition, and wherein the dried coating is not softened by the glosser when changing the ink to the spread condition.

2. The method according to claim 1, wherein the glosser applies a pressure to the ink, wherein the pressure moves the ink to the spread condition.

3. The method according to claim 1, wherein the coating is an aqueous-based mixture.

4. The method according to claim 1, wherein the glosser bonds the coating to the ink and/or the substrate.

5. The method according to claim 1, wherein interaction between the ink and the coating strengthens the ink and coating against removal from the surface of the substrate.

6. A method for protecting an image on a substrate, the method comprising:

applying droplets of ink onto a surface of a substrate in an image configuration;

applying a coating to the surface of the substrate having the ink thereon;

moving the substrate with the ink and coating to a position between heaters located on two sides of the substrate, wherein the heaters heat the substrate and dry the coating, and spreading the ink, after the coating has dried, on the surface of the substrate using a spreader that is located downstream from the heater, wherein the spreader does not soften the dried coating when spreading the ink, wherein the ink and the coating interact during spreading of the ink, and wherein, after spreading, the ink on the surface of the substrate forms the image.

7. The method according to claim 6, further comprising:

using the spreader to apply a pressure to the ink on the substrate with the coating thereon, wherein the pressure increases interaction between the ink and the coating.

8. The method according to claim 6, wherein the coating is an aqueous-based mixture.

9. The method according to claim 6, wherein interaction between the ink and the coating strengthens the ink and coating against removal from the surface of the substrate.

10. The method according to claim 6, wherein the ink is solid ink.

* * * * *